United States Patent [19]

Samp

[11] 4,008,431

[45] Feb. 15, 1977

[54] AUTOMOBILE ENGINE TUNING SCOPE

[75] Inventor: Ronald Lee Samp, Appleton, Wis.

[73] Assignee: The Raymond Lee Organization, Inc., New York, N.Y. ; a part interest

[22] Filed: Sept. 9, 1975

[21] Appl. No.: 611,830

[52] U.S. Cl. ..... 324/16 T

[51] Int. Cl.[2] ..... F02P 17/00

[58] Field of Search ..... 324/16 T; 123/146.5 A; 73/118

[56] References Cited

UNITED STATES PATENTS 3,906,917 9/1975 Lorti ..... 324/16 T X

*Primary Examiner*—Stanley T. Krawczewicz
*Attorney, Agent, or Firm*—Howard I. Podell

[57] ABSTRACT

A scope for tuning an automobile engine which may be remotely located from the engine, in use. The scope is connected to an external flexible shaft fitted with a socket for joining to an engine shaft stud, with a rotatable disc in the scope linked to the shaft. A first neon light bulb or fixed pointer is mounted on a point of the periphery of the disc and a second neon light bulb is mounted in a fixed position adjacent the periphery of the disc. Both light bulbs are joined to a flexible lead wire connectable to a spark plug lead. The socket of the flexible shaft is rotatably adjustable to the shaft with a pointer on the shaft, adjacent the socket, aligned with the relative position of the first light bulb on the disc.

3 Claims, 4 Drawing Figures

AUTOMOBILE ENGINE TUNING SCOPE

SUMMARY OF THE INVENTION:

My invention is a scope for tuning an automobile engine which may be remotely located from the engine, in use. The scope is connected to an external flexible shaft fitted with a socket for joining to an engine shaft stud, with a rotatable disc in the scope linked to the shaft. A first neon light bulb or fixed pointer is mounted on a point of the periphery of the disc and a second neon light bulb is mounted in a fixed position adjacent the periphery of the disc. Both light bulbs are joined to a flexible lead wire connectable to a spark plug lead. The socket of the flexible shaft is rotatably adjustable to the shaft with a pointer on the shaft, adjacent the socket, aligned with the relative position of the first light bulb on the disc.

In use, the socket is connected to the engine stud and rotatably adjusted to the shaft so that the shaft pointer is aligned with the timing mark on the engine shaft. With the engine operating, the lights will flash each time the first cylinder spark plug fires, with the relative location of the first light or pointer to the second light indicating the degree of timing adjustment of the engine.

Since the scope indicator of my invention is in the form of two gas discharge lights, it may be employed under relatively bright ambient lighting conditions, as contrasted with conventional timing stroboscopic equipment which requires the absence of ambient light.

BRIEF DESCRIPTION OF THE DRAWINGS:

The objects and features of the invention may be understood with reference to the following detailed description of an illustrative embodiment of the invention, taken together with the accompanying drawings in which.

Figure 1:
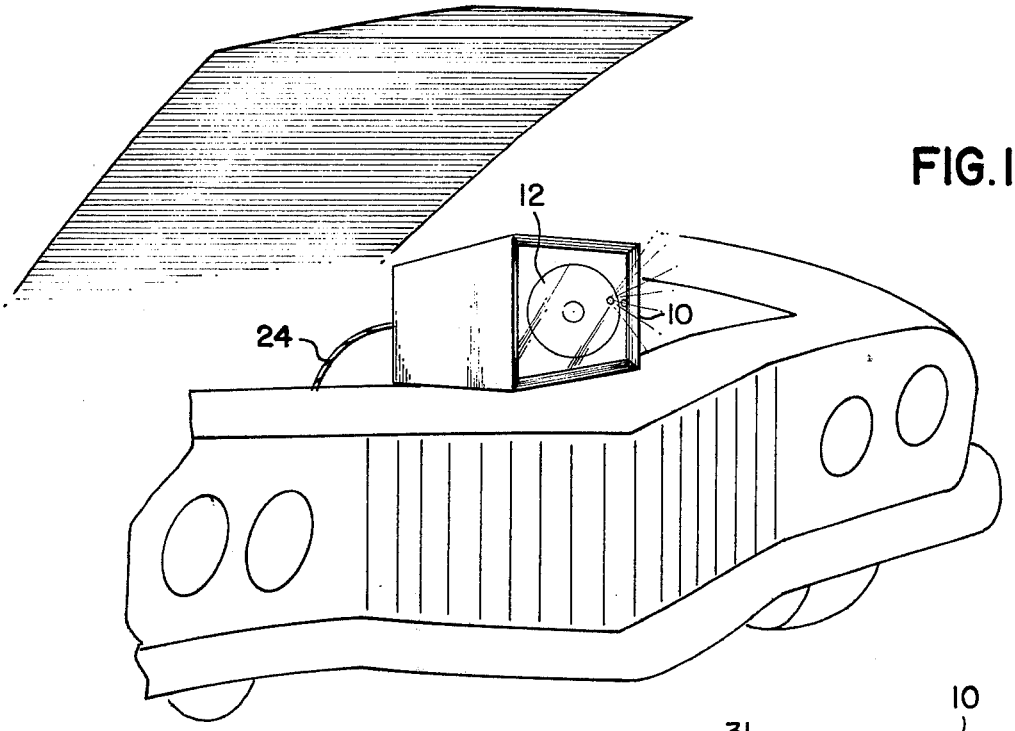
FIG. 1 is a perspective view of the viewing scope of the invention in use.
Figure 2:
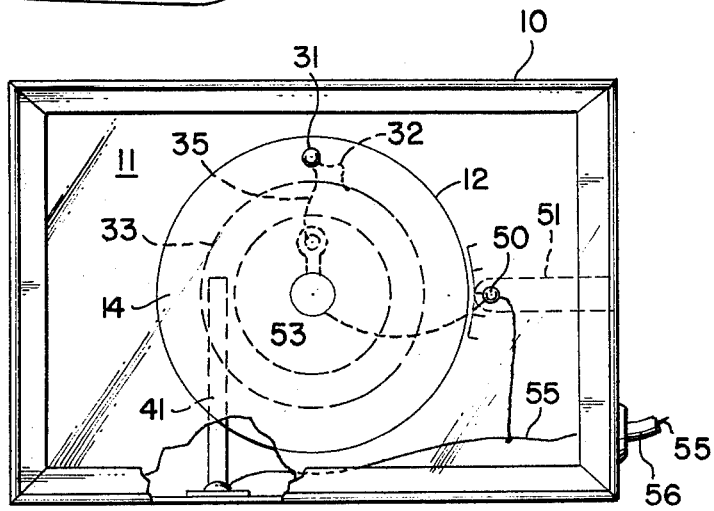
FIG. 2 is an elevation view of the viewing scope of the invention.
Figure 3:
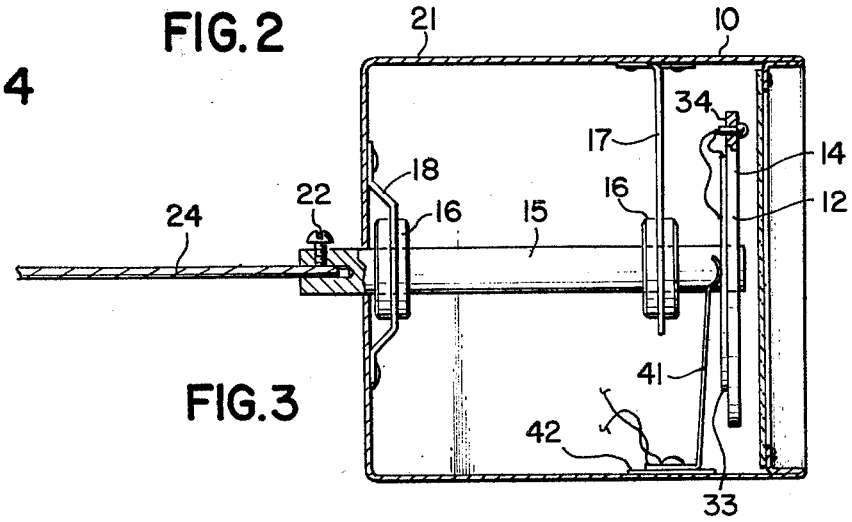
FIG. 3 is a side sectional view of the viewing scope.

DESCRIPTION OF THE PREFERRED EMBODIMENT:

Turning now descriptively to the drawings, in which similar reference characters denote similar elements throughout the several views, FIGS. 1–3 illustrate the scope box 10 fitted with a tinted glass face 11. A disc 12, the face 14 of which is visible through the glass 11, is fixed to a shaft 15 mounted on bearings 16 fixed to brackets 17 and 18 fastened internally to the housing 21 of the box 10. Shaft 15 projects externally of housing 21 and is fastened by a set screw 22 to a flexible shaft 24.

A first gas discharge light bulb 31 is mounted to disc 12 so as to be visible through glass 11 and a first wire lead 32 from bulb 31 is connected to a metal ring 33 mounted on the rear surface 34 of disc 12. Disc 12 is preferably made of insulating material, or if made of an electrical conductor, insulated from metal ring 33. A second wire lead 35 is connected from bulb 31 to a bearing 16 of shaft 15 so as to connect lead 35 to shaft 15 which serves as a ground wire of the electrical circuit.

A flat spring 41 is mounted on insulating washer 42 to the inside of the housing 21 and shaped to bear against metal ring 33 so that spring 41 is in electrical contact with ring 33 but insulated from housing 21.

A second gas discharge bulb 50 is mounted in a bracket 51 fixed to the housing 21 with bulb 50 insulated from bracket 51 and with one electrical wire 53 from bulb 50 joined to ground wire 35 of the first bulb 31 and a second electrical wire 54 from bulb 50 joined to a wire 55 leading from flat spring 41 so that bulbs 31 and 50 are connected in parallel. Wire 55 extends in a flexible insulated sheath 56 out of housing 21 being fitted with clamp means at its free end for connecting to a spark plug contact in the engine.

Figure 4:
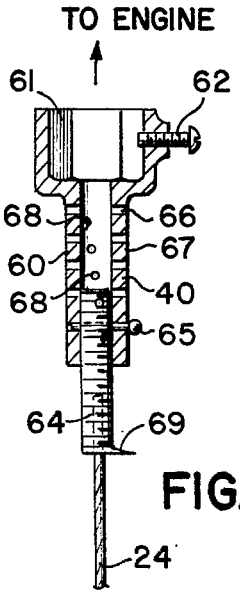
FIG. 4 is a sectional view of the attachment socket of the invention.

Flexible shaft 24 extends from shaft 15 to a socket 60 as shown in FIG. 4, with socket 60 formed with an internal shaped recess 61 for fitting about the stud of an engine shaft (not shown). A set screw 62 mounted to the wall of socket 60 serves to tighten socket 60 to the said engine shaft.

Socket 60 is fixed to rod 64 by a removable pin 65 which passes through one set of a plurality of transverse through holes 66 in the end of socket 60 formed as a sleeve 67. Rod 64 is fixed to the end of shaft 24 and formed with a series of through transverse holes 68, with the axis of each hole 68 angularly offset from the axis of adjoining holes 68 so that passage of pin 65 through a particular hole 68 and the matching pair of transverse holes 66 of sleeve 67 serves to fix socket 60 in a particular rotated alignment with bar 64, shaft 24 and the position of light bulb 31 of disc 12. A pointer 69 extends radially from bar 64 to enable the user to align pointer 69 with the timing mark (not shown) on the engine shaft to which socket 60 is connected, by positioning of pin 65 in a set of holes 68 and 66.

In use, light bulbs 31 and 50 will flash intermittently as the engine, to which socket 60 is fastened, rotates, when wire 55 is connected to a spark plug terminal connected to the engine distributor.

Such flashing lights may appear as steady lights to the observer, but because of stroboscopic effect, illuminated light bulb 31 will appear to be in a fixed position in relation to fixed bulb 50, although it is on a rotating disc.

Adjustment of the timing circuit of the automobile engine will move the observed position of light bulb 31 with relation to the fixed position of light bulb 50.

For use under darkened ambient conditions, light bulb 50 may be replaced by a fixed mark illuminated by light bulb 31 or light bulb 31 may be replaced by a fixed mark on disc 12 illuminated by light bulb 50. However, the preferred embodiment utilizing two light bulbs may be used under conditions of high ambient light.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim and desire to secure by Letters Patent of the United States is:

1. A timing stroboscope, the viewing section of which may be remotely located from an internal combustion engine to which it is attached for timing purposes, comprising a housing enclosing a shaft rotatably mounted in said housing a first gas discharge light bulb mounted to a member fastened to the shaft a second gas discharge light bulb mounted to a fixed member fastened to the housing, said second light bulb mounted so as to be visible from a viewing position in which the first light bulb is also visible, said housing formed with a window opening located to permit an observer to view both light bulbs simultaneously, a flexible rotatable cable linking the said shaft with socket means for fastening to a shaft of an internal combustion engine, and electric circuitry means joining both lamp bulbs in parallel to a flexible wire extending from the shaft and to a ground connection of the engine.

2. The combination as recited in claim 1 in which the socket means comprise a socket fitted to a member, extending from the end of the flexible rotatable cable, with means to rotate the socket relative to the said member and means to fix the socket in a given position of rotatable alignment of the socket and said member.

3. The combination as recited in claim 2 in which a pointer projects from the member fastened to the rotatable cable.

* * * * *